United States Patent [19]

Straitz, III

[11] 4,269,583

[45] May 26, 1981

[54] PILOTS FOR FLARE STACKS

[75] Inventor: John F. Straitz, III, Meadowbrook, Pa.

[73] Assignee: Combustion Unlimited Incorporated, Philadelphia, Pa.

[21] Appl. No.: 908,582

[22] Filed: May 22, 1978

[51] Int. Cl.[3] ..... F23D 13/20

[52] U.S. Cl. ..... 431/202; 431/285

[58] Field of Search ..... 431/202, 278, 285

[56] References Cited

U.S. PATENT DOCUMENTS

| | | | |
|---|---|---|---|
| 2,869,631 | 1/1959 | Zink | 431/202 |
| 3,729,287 | 4/1973 | Strashok | 431/202 |
| 3,932,111 | 1/1976 | Liknes et al. | 431/202 |
| 3,982,881 | 9/1976 | Schwartz et al. | 431/202 |

*Primary Examiner*—Carroll B. Dority, Jr.

*Attorney, Agent, or Firm*—Seidel, Gonda, Goldhammer & Panitch

[57] ABSTRACT

Pilots for waste gas flare stacks are disclosed suitable for use with stacks having natural draft or forced draft in which the pilot burner head to which a combustible gas-air mixture is supplied is at the upper end of a tube carried by the stack for supplying additional air to the pilot burner head, the pilot burner head being located close to the outlets for the waste combustible gas to be burned, and preferably close to the center of the stack, provisions being made to ignite the gas-air mixture at the pilot burner head. A thermocouple may also be carried in the pilot burner head to provide information at a remote location as to pilot burner operation.

12 Claims, 5 Drawing Figures

PILOTS FOR FLARE STACKS

BACKGROUND OF THE INVENTION

1. Field of the Invention

This invention relates to pilots for waste gas flare stacks and more particularly to pilots having a pilot burner head at the top of a flare stack.

2. Brief Description of the Prior Art

It has heretofore been proposed in order to ignite the combustible waste gas delivered to the top of a flare stack to provide a plurality of gas burning pilots around the periphery of the flare stack at the discharge end, the number of pilots being determined by the diameter of the flare stack.

The peripherally located pilots heretofore available included upwardly directed burner heads and burner heads directed inwardly toward the discharging stream of combustible gas.

In forced draft systems, the fan, customarily having two operating speeds, was usually located at or near the bottom of the stack, and was either manually or automatically controlled. This gave rise to a situation where there could be a very low gas flow with a very high air blower flow. This condition gave rise to problems of ignition of the waste gas by the pilot. Another situation also occurred when there was very low gas flow and no blower flow where the gas, being heavier than air, gave rise to the possibility of down flow of the gas, and admixture of the gas with air near the ground thereby creating an explosion hazard.

The use of a plurality of peripherally disposed continuously operating gas pilots as referred to above also resulted in substantial waste of pilot gas.

SUMMARY OF THE INVENTION

In accordance with the invention a gas pilot burner for igniting waste combustible gas discharging from a flare stack is provided, suitable for use with forced air draft or induced air draft, and preferably a single gas pilot burner, burning a mixture of air and combustible gas, such as fuel gas, with an air tube within which the burner head is mounted for supplying additional air for combustion, from interiorly or exteriorly of the flare stack, the burner head being located close to the gas outlets such as between hollow outwardly extending gas directing vanes, and close to the center to provide a positive pilot action and positive air flow even if there is no blower or the blower is not operating, the arrangement of the pilot burner head near the center and not affected by wind direction permitting of substantial reduction of pilot gas consumption. The pilot burner head is also particularly suited for mounting a thermocouple to give an indication of pilot burner head operation.

It is the principal object of the invention to provide an improved gas pilot burner with substantial saving in pilot gas consumption, the location of the pilot burner head facilitating ignition of the waste combustible gas and providing a positive upward air flow in the flare stack.

It is a further object of the invention to provide an improved gas pilot burner which is effective with low flow of waste combustible gas.

It is a further object of the invention to provide a pilot burner head for flare stacks of the character aforesaid which is suited for ignition by an advancing flame front directed thereto.

It is a further object of the invention to provide a pilot burner head for flare stacks which is adapted to support a themocouple responsive to the conditions at the pilot burner head.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
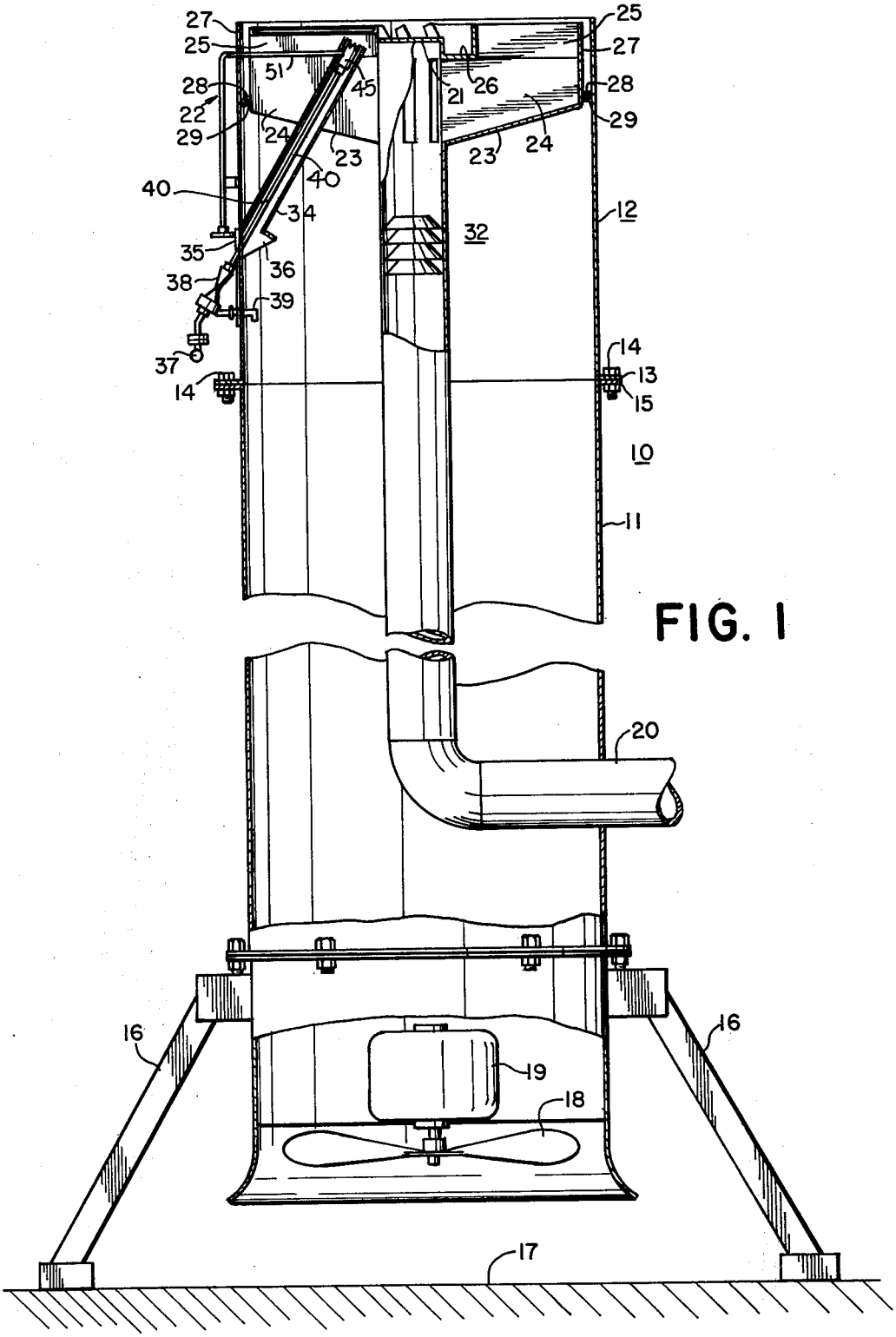
FIG. 1 is a view in elevation of a flare stack with positive draft having the pilot of the present invention therein, parts being shown in vertical section to illustrate the details of construction.

Referring now more particularly to FIG. 1 of the drawings, a flare stack 10 is shown having a lower supporting stack portion 11 and a burner tip portion 12 with a lower flange 13 for detachable connection by bolts 14 to an upper flange 15 on the stack portion 11.

The supporting portion 11 can be carried on spaced legs 16 mounted on a foundation 17 and provided with a blower 18 and blower motor 19 to deliver air upwardly within the stack 10.

A combustible waste gas supply pipe 20 is provided for the delivery of the gas for combustion which may be refinery wastes or combustible waste gases from chemical processes.

The pipe 20 extends through the wall of the stack 10 and upwardly and is closed at the top by a closure plate 21. A plurality of vanes 22 extend outwardly from the pipe 20, in communication therewith, have inclined bottom walls 23, parallel vertical side walls 24 and spaced inclined and converging walls 25 providing nozzles directing the gas in a vortex path. Upper closure walls 26 close the tops of the walls 24 and end walls 27 close the outer ends of the walls 24 and 25. The walls 27 can have supporting hooks 28 engaged in plates 29 on the interior of the burner tip 12.

The pipe 20 in order to prevent down flow of air in the interior, whether by external wind conditions or contraction by cooling of the waste combustible gas in the system and also to reduce fluid oscillations, is preferably provided with a fluidic diode 32 such as is shown in my prior U.S. Pat. No. 3,730,673.

Referring now to FIG. 1, the pilot there shown is for forced draft and includes an air tube 34, carried by a mounting plate 35 detachably secured to the burner tip portion 12.

The air tube 34 extends diagonally upwardly and inwardly and has an air scoop portion 36 interiorly disposed in the main burner tip portion 11 for directing air into and upwardly within the air tube 34.

A combustible pilot gas supply pipe 37 is provided for delivery of pilot gas and extends to a venturi 38 which has an air supply connection 39 through the mounting plate 35 and into the interior of the burner tip portion 11 for delivery of air induced by the venturi 38 for admixture with the gas to provide a suitable gas/air mixture. A gas/air supply pipe 40 extends to and is in threaded engagement in a fitting 41. The fitting 41 has a disc 42 therein with a central opening 43 and a plurality of smaller flame retention openings 44 therearound. The fitting 41 has a cylindrical burner head 45 extending from the disc 42 with a plurality of air admission openings 46 therethrough and a serrated end 47.

The pilot burner head 45 is preferably positioned within the air tube 34 by a plurality of spaced lugs 48 with guide surfaces 49 to facilitate the insertion of the head 45.

The burner head 45 has a side wall opening 50 with an igniter tube 51, extending through the wall of the air tube 34 for delivery of an igniting flame to ignite the gas/air mixture supplied into the pilot burner head 45 to provide the pilot flame. The use of a flame front, pulsating or continuous, directed through a pipe, such as the igniter tube 51, is well known and accordingly need not be described in detail.

If desired, a thermocouple 53 can be provided, disposed within the burner head 45 and with conductors 54 extending therefrom, through one of the openings 44 and downwardly through the gas/air supply pipe 40 for providing a signal indicating the temperature conditions prevailing at the pilot burner head 45.

Figure 2:
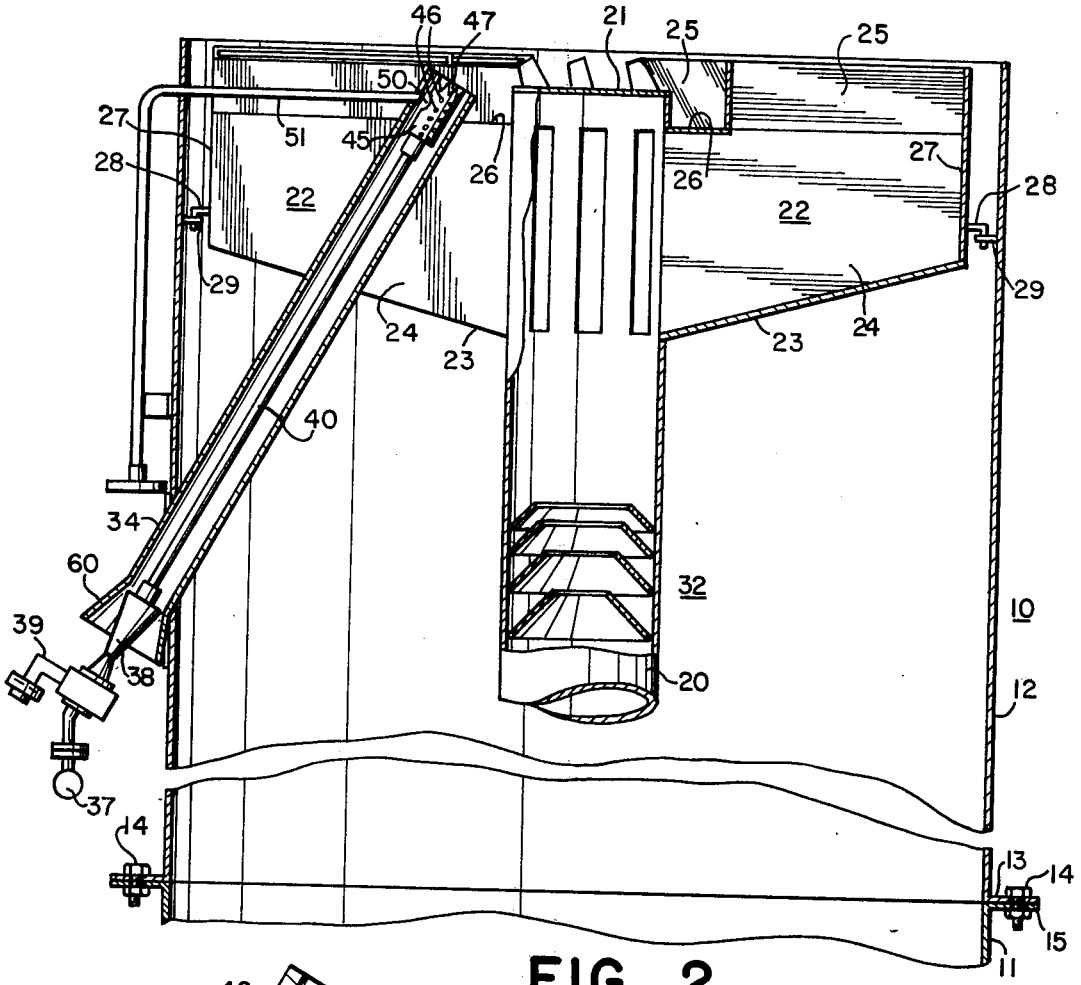
FIG. 2 is a vertical sectional view of the burner tip portion of a flare stack with natural draft.
Figure 4:
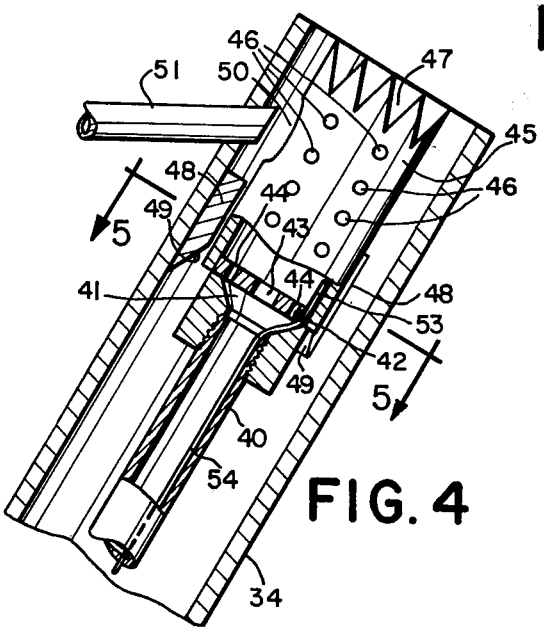
FIG. 4 is an enlarged fragmentary vertical sectional view showing the details of construction of the pilot burner head.
Figure 5:
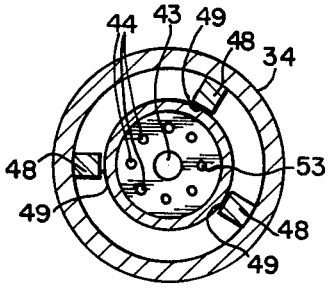
FIG. 5 is a transverse sectional view taken approximately on the line 5—5 of FIG. 4.
Figure 3:
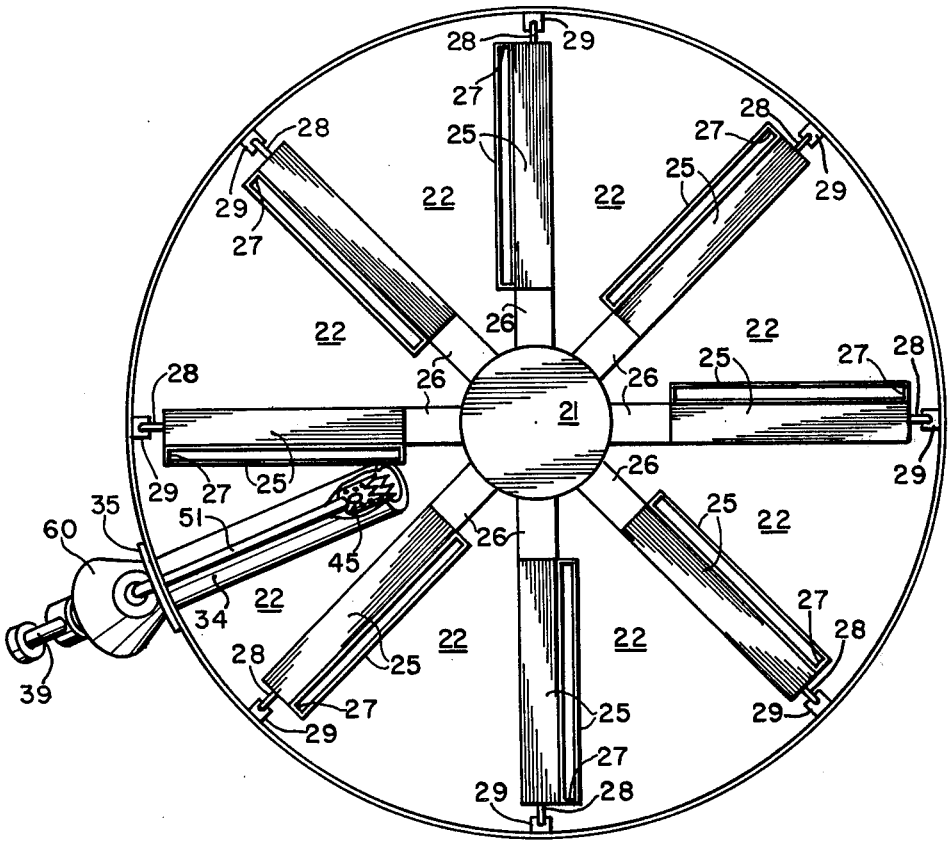
FIG. 3 is a top plan view of the burner tip portion of FIG. 2.

If the flare stack has induced draft the arrangement shown in FIG. 2 will be employed. The air tube 34 has an exteriorly disposed air scoop 60 within which the venturi 38 can be placed.

The pilot gas supply pipe 37 is connected to the venturi 38 and an air inlet supply connection 39 is connected to the inlet of the venturi 38.

The mode of operation will now be pointed out first with reference to FIG. 1.

Air is supplied upwardly within the flare stack 10 by the blower 18 for delivery to the discharge end of the burner tip portion 11. Combustible waste gas is supplied through the pipe 20 to and outwardly through the vanes 22 for discharge in a helical path between the nozzle walls 25 for combustion.

Pilot gas is supplied by the pipe 37 to the venturi 38 to which air is also supplied from within the stack 10 through the air supply connection 39 and to and through the pilot burner head 45 for ignition.

With pilot gas and air supplied to the pilot burner head 45 the mixture is ignited by a flame front advanced through the tube 51 and side wall opening 50 into the pilot burner head 45. The gas-air mixture supplied by the pipe 40 is combustible but combustion is further aided by the secondard air supplied through the air tube 34 and entering through the openings 46 and opening 50 to the flame at and beyond the central opening 43 and supplying air beyond the end of the burner head 45. The openings 44 serve as openings for delivery of gas and air and by the multitude of small flames at these openings function as flame retention openings.

The flame at the pilot burner head 45 is available to ignite the combustible waste gas-air mixture at the discharge end of the burner tip portion 12.

The location of the pilot burner head 45 at or close to the discharging stream of waste combustible gas and air facilitates ignition of that stream and renders unnecessary the use of a plurality of pilot burner heads so that a saving of pilot gas is effected.

The pilot burner head 45 carried within the air tube 34 can be readily removed for inspection and maintenance by reason of the detachability of the pipe 37 and may be slid out of the tube 34. The ignition tube 51 as shown does not hinder such removal and insertion.

The thermocouple 53 and its conductors also makes available a signal indicating the conditions at the pilot burner head 45.

It will thus be seen that structure has been provided with which the objects of the invention are attained.

I claim:

1. A flare stack including a pilot burner, means for delivering air through said stack to the terminal end of said stack, said stack having means for delivering waste combustible gas through nozzle means at said terminal end of said stack for combustion at said terminal end in the atmosphere, a pilot burner head interiorly disposed in said stack at said terminal end of the stack and adjacent to said nozzle means, means for supplying a combination of combustible gas and air to said pilot burner head for combustion, and means for providing additional air to said burner head comprising an air tube within said stack in which said burner head is positioned for aiding combustion and stabilizing the pilot burner flame.

2. A flare stack as defined in claim 1 in which said burner head is adjacent to the center of the stack.

3. A flare stack as defined in claim 1 in which said air tube has an inlet end disposed within the stack, and air supply means is provided for said stack.

4. A flare stack as defined in claim 1 in which said air tube has an inlet end disposed exteriorly of the stack for induction of air thereinto.

5. A flare stack as defined in claim 1 in which said burner head has an inlet fitting with a portion having openings for discharge of pilot gas into said burner head, and said burner head has an elongated side wall portion with a plurality of openings therealong communicating with the interior for delivery of air thereinto.

6. A flare stack as defined in claim 5 in which said portion of said fitting is provided with a plurality of flame retention openings.

7. A flare stack as defined in claim 1 in which said air tube is supported by the stack, and said air tube is inclined inwardly and extends upwardly towards said terminal end of the stack.

8. A pilot burner as defined in claim 7 in which said burner head is adjacent to the center of said stack.

9. A flare stack as defined in claim 1 in which said burner head has a heat responsive element therein.

10. A flare stack as defined in claim 9 in which conductors extend from the heat responsive element and downwardly along said means for supplying a combination of air and combustible gas to said burner head.

11. A flare stack as defined in claim 1 in which an igniter tube is provided and is in communication with said burner head.

12. A flare stack as defined in claim 11 in which said igniter tube extends through said air tube and communicates with the interior of said burner head.

* * * * *